US011746432B2

(12) United States Patent
Magnesen et al.

(10) Patent No.: US 11,746,432 B2
(45) Date of Patent: Sep. 5, 2023

(54) METHOD AND MEANS FOR APPLICATION OF ANODE COVERING MATERIAL (ACM) IN AN ELECTROLYSIS CELL OF HALL-HEROULT TYPE FOR ALUMINIUM PRODUCTION

(71) Applicant: NORSK HYDRO ASA, Oslo (NO)

(72) Inventors: Jostein Magnesen, Årdalstangen (NO); Per Johnny Teigen, Øvre Årdal (NO); Jan Frode Høines, Sævelandsvik (NO); Odd Erik Jacobsen, Sandefjord (NO); Are Dyrøy, Porsgrunn (NO); Morten Karlsen, Øvre Årdal (NO); Juraj Chmelar, Årdalstangen (NO)

(73) Assignee: NORSK HYDRO ASA, Oslo (NO)

( * ) Notice: Subject to any disclaimer, the term of this patent is extended or adjusted under 35 U.S.C. 154(b) by 1248 days.

(21) Appl. No.: 15/776,218

(22) PCT Filed: Oct. 4, 2016

(86) PCT No.: PCT/NO2016/000027

§ 371 (c)(1),
(2) Date: May 15, 2018

(87) PCT Pub. No.: WO2017/086799

PCT Pub. Date: May 26, 2017

(65) Prior Publication Data

US 2020/0248327 A1 Aug. 6, 2020

(30) Foreign Application Priority Data

Nov. 20, 2015 (NO) ..... 20151597

(51) Int. Cl.

| | |
|---|---|
| ***C25C 7/02*** | (2006.01) |
| ***C25C 3/12*** | (2006.01) |
| ***C25C 3/14*** | (2006.01) |

(52) U.S. Cl.
CPC ..... *C25C 7/025* (2013.01); *C25C 3/12* (2013.01); *C25C 3/14* (2013.01)

(58) Field of Classification Search
CPC ..... C25B 3/12–3/14; C25B 7/025; C25C 3/12–3/14; C25C 7/025
See application file for complete search history.

(56) References Cited

U.S. PATENT DOCUMENTS 4,172,018 A 10/1979 Moix et al.
4,302,302 A * 11/1981 Kaifuchi ..... C25C 3/14 204/245

(Continued)

FOREIGN PATENT DOCUMENTS

CN 2741993 11/2005
CN 203346490 12/2013

(Continued)

OTHER PUBLICATIONS

International Search Report dated Dec. 1, 2016 in International Application No. PCT/NO2016/000027.

(Continued)

*Primary Examiner* — Alexander W Keeling
(74) *Attorney, Agent, or Firm* — WENDEROTH. LIND & PONACK. L.L.P.

(57) ABSTRACT

A method and means for application of anode covering material (ACM) in an electrolysis cell for aluminium production where the cell being of Hall-Héroult type with prebaked anodes. The cell contains a cathode pot with a rectangular footprint and a superstructure with a gas collecting hood that lays onto the top of the cathode pot. A floor construction at least substantially surrounds the cell at a level below the top of the cathode pot and ventilation openings provided with grates are arranged in the floor in the close vicinity to the cell. The superstructure's hood is provided with removable lids that are removed for giving (Continued)

Figure 1:
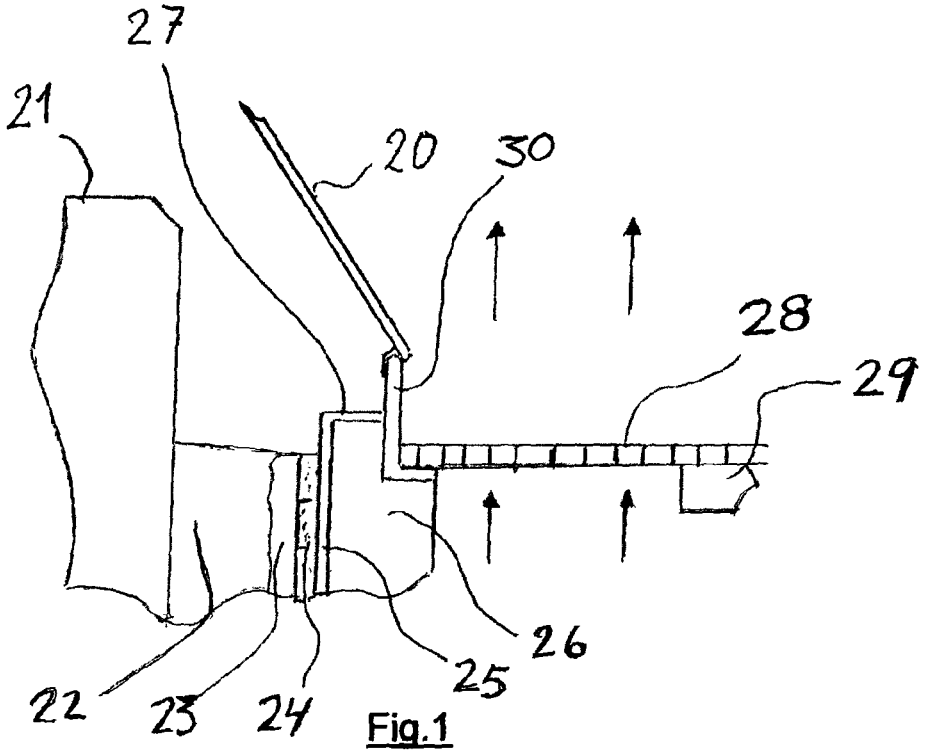

access to the cell's anodes through openings. ACM is applied via a feed tube to cover the anodes and the deposit of ACM is supported by a shuttering.

6 Claims, 5 Drawing Sheets

(56) References Cited

U.S. PATENT DOCUMENTS

| | | | | |
|---|---|---|---|---|
| 4,498,818 | A * | 2/1985 | Bjarnason | B65D 90/54 406/137 |
| 5,045,168 | A * | 9/1991 | Dalen | C25C 3/14 204/247 |
| 5,324,408 | A * | 6/1994 | Kissane | C25C 3/14 204/245 |
| 5,524,768 | A * | 6/1996 | de Silva | B07B 4/08 209/354 |
| 5,779,875 | A * | 7/1998 | Budaev | C25C 3/14 204/245 |
| 2016/0326661 | A1* | 11/2016 | Martin | C25C 3/12 |

FOREIGN PATENT DOCUMENTS

| | | |
|---|---|---|
| CN | 103498173 | 1/2014 |
| DE | 23 30 557 | 1/1975 |
| DE | 24 13 763 | 10/1975 |
| FR | 893040 | 5/1944 |
| FR | 1495653 | 9/1967 |
| GB | 20000521 | 1/1979 |

OTHER PUBLICATIONS

Hasini Wijayartne et al., "Effects of Composition and Granulometry on Thermal Conductivity of Anode Cover Materials", TMS (The Minerals, Metals, & Materials Society), Light Metals 2011, pp. 399-404.

Search Report dated Jun. 20, 2016, in corresponding Norwegian Patent Application No. 20151597.

Supplementary European Search Report dated Aug. 30, 2019, in corresponding European Patent Application No. 16866723.

* cited by examiner

METHOD AND MEANS FOR APPLICATION OF ANODE COVERING MATERIAL (ACM) IN AN ELECTROLYSIS CELL OF HALL-HEROULT TYPE FOR ALUMINIUM PRODUCTION

The present invention concerns a method and means for application of anode covering material (ACM) in an electrolysis cell of Hall-Héroult type for aluminium production. In particular, the invention relates to shuttering of ACM during application of it onto anode tops and the sides thereof, to control the geometrical configuration and location of the ACM deposit by using a temporary shuttering.

Aluminium is presently produced by electrolysis of an aluminium-containing compound dissolved in a molten electrolyte, and the electrowinning process is performed in cells of conventional Hall-Héroult design in an electrolysis plant. Commonly, such cells comprise a cathode pot with a rectangular footprint and a superstructure with a gas collecting hood that lays onto the top of the cathode pot, and where a floor construction surrounds the cell at a level below the top of the cathode pot. Ventilation openings are arranged in the floor in the close vicinity to the cell creating an updraugt from a basement below the floor and into the plant's atmosphere that surrounds the cells. The gas collecting hood is provided with removable lids that are removed for giving access to the cell's anodes through openings during application of ACM onto one or more anodes.

Further, these electrolysis cells are equipped with horizontally aligned electrodes, where the electrically conductive anodes and cathodes of today's cells are made from carbon materials. The electrolyte is based on a mixture of sodium fluoride and aluminium fluoride, with smaller additions of alkaline and alkaline earth fluorides. The electrowinning process takes place as the current passed through the electrolyte from the anode to the cathode causes the electrical discharge of aluminium-containing ions at the cathode, producing molten aluminium, and the formation of carbon dioxide at the anode. The overall reaction of the process can be illustrated by the equation:

$$2Al_2O_3+3C=4Al+3CO_2 \quad (1)$$

The preferred prebaked carbon anode blocks of today's cells are consumed in the process according to reaction (1), with a typical gross anode consumption of 500 to 550 kg of carbon per tonne of aluminium produced. Even though the carbon material and the manufacture of the anodes are relatively inexpensive, the handling of the used anodes (butts) makes up a major portion of the operating cost in a modern primary aluminium smelter.

The raw material used in the Hall-Héroult cells is aluminium oxide, also called alumina. Alumina has a relatively low solubility in most electrolytes. In order to achieve sufficient alumina solubility, the temperature of the molten electrolyte in the electrowinning cell must be kept high. Today, normal operating temperatures for Hall-Héroult cells are in the range 940-970° C.

Anode covering material (ACM) is applied as a covering material on the top and at the sides of the anode blocks, and as well as an encapsulating layer above the electrolytic bath. The purpose is to protect the anodes from unwanted oxidation and air-burn, and also to thermally insulate the electrolyte from heat losses into the superstructure above it as it is crucial with regard to the cell's heat balance. The layer of ACM will also contribute to control of fluoride losses.

The importance of the ACM's properties is discussed in the following TMS article; Light Metals 2011, 'EFFECTS OF COMPOSITION AND GRANULOMETRY ON THERMAL CONDUDUCTIVITY OF ANODE COVER MATERIALS' Hasini Wijayaratne, Mark Taylor, Tania Groutso (Light Metals Research Centre, The University of Auckland, Private Bag 92019, New Zealand and Andreea Grama (Department of Chemical & Materials Engineering, The University of Auckland, Private Bag 92019, New Zealand).

It has been observed that the thermal conductivity of ACM is strongly dependent on its packing (due to voidage) and particle size distribution.

Commonly, ACM is a mixture of crushed bath and alumina, primary alumina and/or secondary alumina, in a ratio dependent of the electrolysis technology at the actual site. Such material can consist of a substantial amount of recycled material, for instance bath and/or crust material grabbed out of electrolysis cells when replacing anodes or material removed from butts in a rodding facility.

In most existing installations for mixing of crushed bath and alumina to make ACM, mechanical mixers are used, mostly ordinary batch mixers or just metering plural material streams by screw conveyors at the desired mixing ratio onto belt conveyors. To apply an ACM with homogenous particle distribution is important for heat balance in the cell.

In modern plants, the ACM is applied to the cells by a Pot Tending Machine (PTM) which is commonly a crane with a cabin for an operator and further provided with several maintenance tools for servicing the cells. The ACM is stored in a bin on the crane and can be applied to the cells via a discharge or feed tube. For instance, when an anode is worn out, it has to be replaced with a new one. After replacement, the new anode is at least partly covered with ACM. ACM may also be applied by vehicles having ACM onboard.

Commonly, the anodes in a cell of the above mentioned type are arranged in two rows, where access to the rows is from opposite sides of the superstructure. The anode change and maintenance is done via temporary openings in the superstructure's gas hood, normally closed by lids. During anode change and subsequent ACM discharge there may be spillage out of the cell, in particular as the side of the anode facing the opening is to be covered.

One disadvantage with the common methods is that ACM is poured by gravity and allowed to flow onto the area to be covered, thus forming a dynamic angle of repose. The final result is much dependent upon the flow velocity of the ACM and its particle size distribution. The angle of repose of the material will also influence the final result. Often the application of ACM results in dusting, spillage of ACM outside the cell and further into the basement through ventilation openings in the floor surrounding the cell, and an uneven distribution of the ACM (too much in some areas and too little in other).

According to the present invention a shuttering method and means can remedy many of this disadvantages.

Further, it has been found that by closing the ventilation openings in the floor in the area where application of ACM is taking place, the updraught of ventilation air from the basement below the floor is restricted and there will be less turbulence disturbing the inflow of air into the open part of the hood. As a consequence, less fines will be distributed to the plant's atmosphere.

In addition, ACM that may be spilled out of the cell during its application will be restricted from falling down into the basement, due to the closure of the ventilation openings. It has been observed that the amount of ACM falling into the basement has been reduced to somewhere between 20%-10% of the previous amount. Thus, maintenance cleaning will become more convenient.

According to the present invention the ACM can be applied with more precision and also with reduced dusting and spillage to the working environment. Due to the geometry of the shuttering and preferably also assisted by an applicator plate attached to the feed tube, the ACM can be arranged with an angle of repose that is steeper than its inherent angle of repose. This makes it possible to cover the anode tops and sides with more precision and a more accurate insulation layer can be obtained.

These and further advantages can be achieved with the present invention as defined in the accompanying claims.

Figure 2:
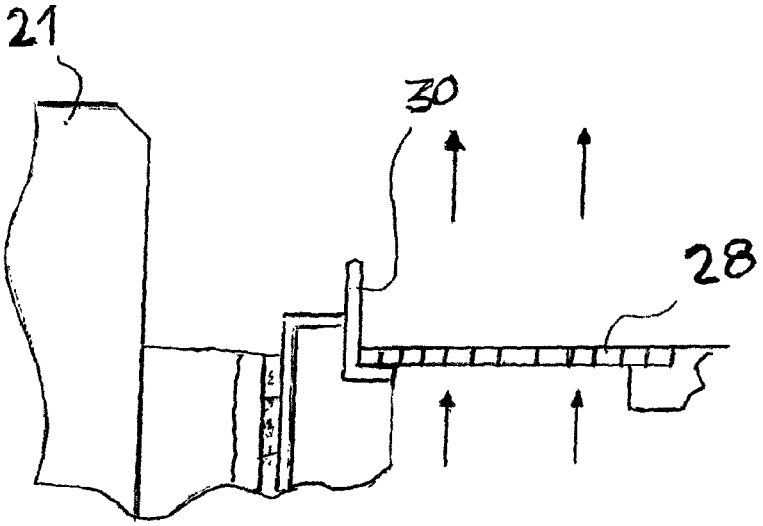
Figure 3:
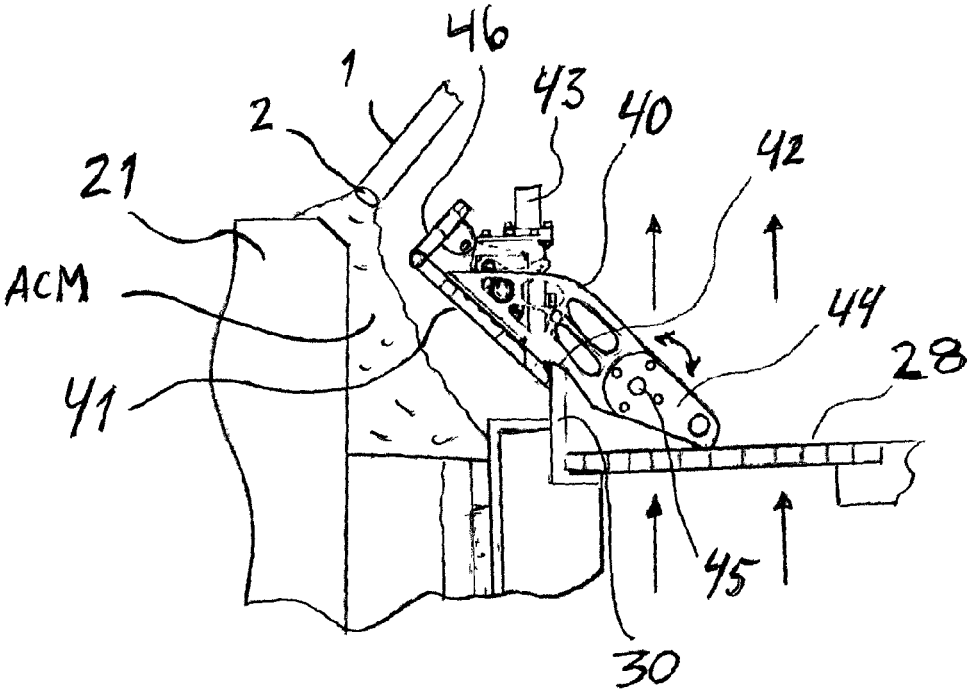
Figure 4:
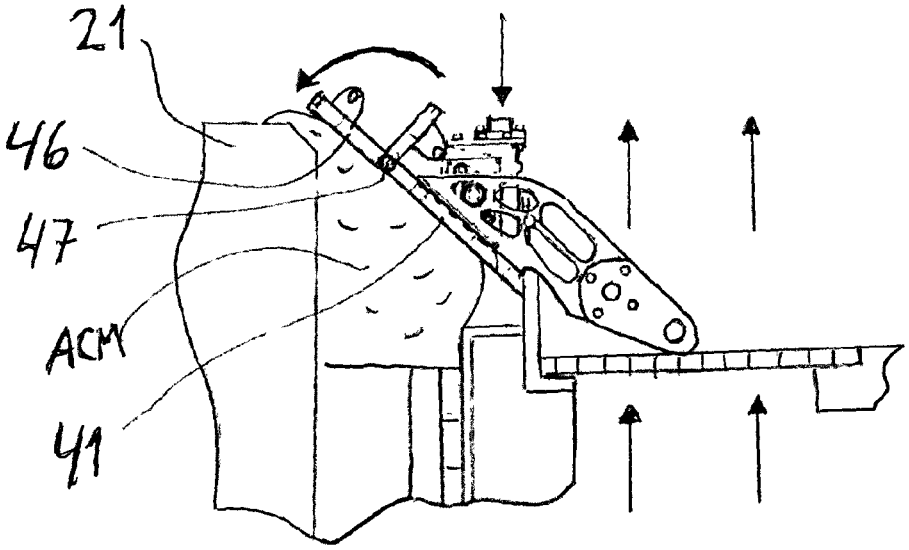
Figure 5:
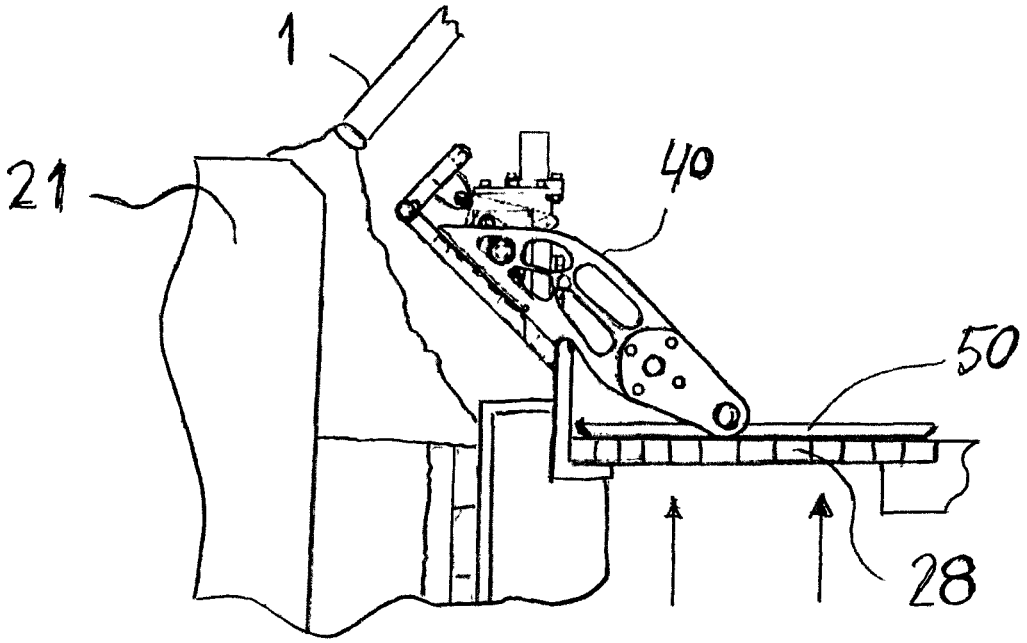
Figure 6:
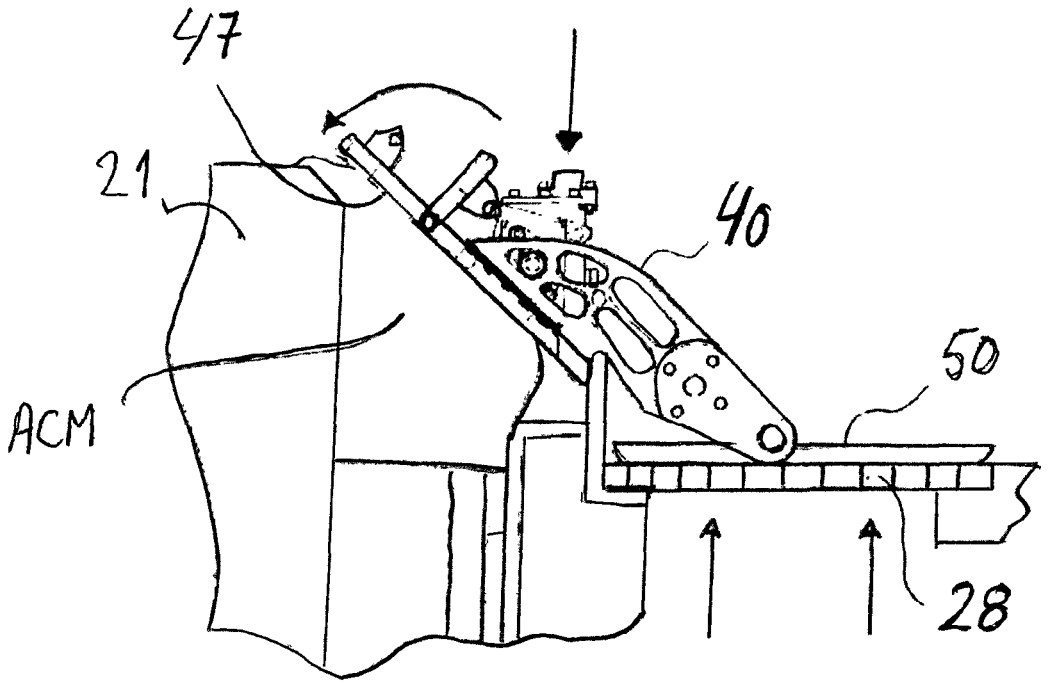
Figure 7:
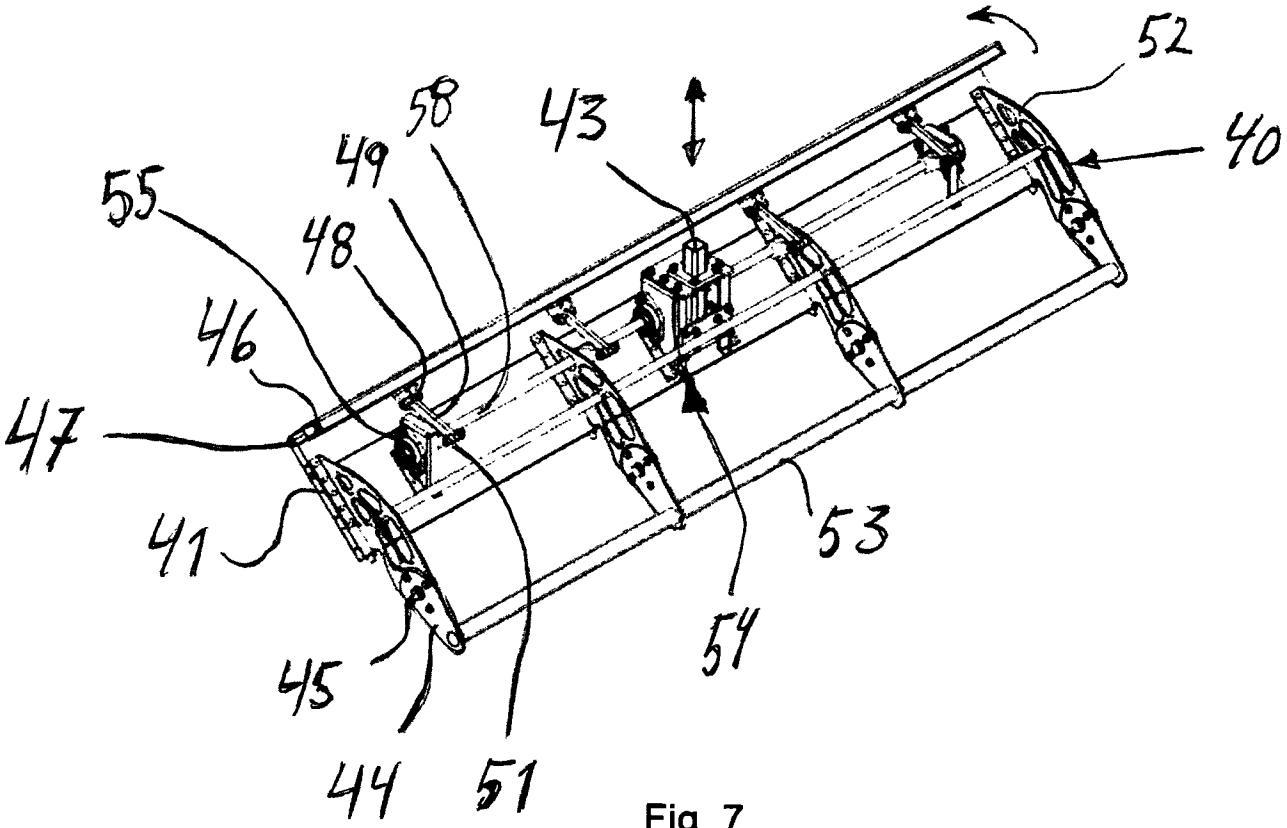
Figure 8:
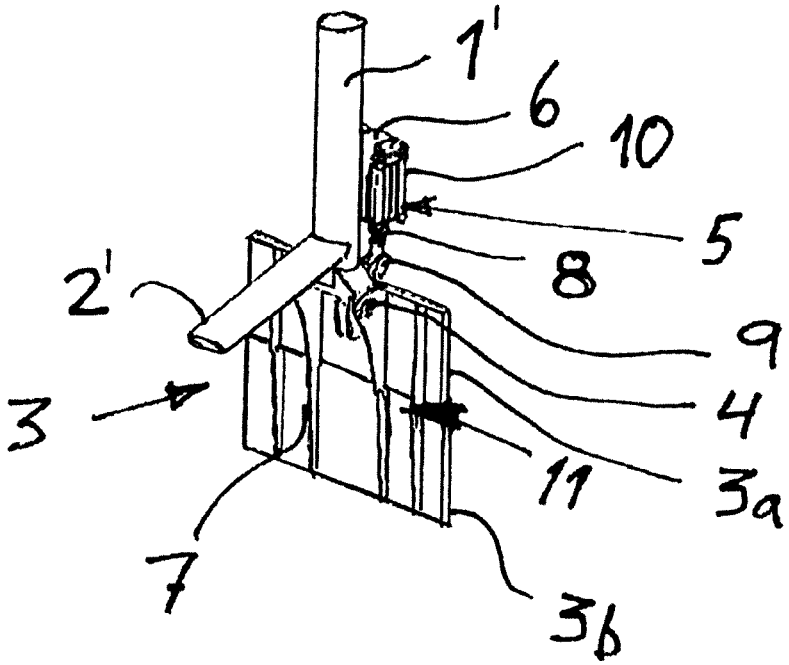
Figure 9:
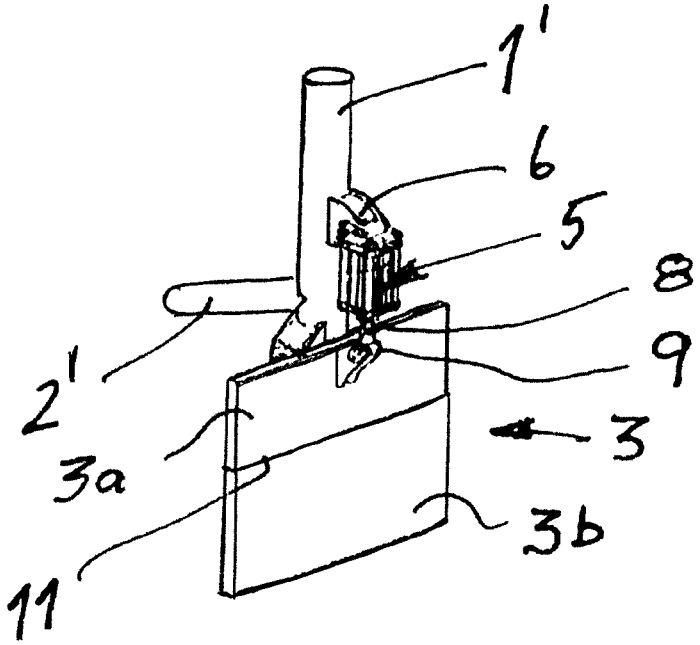

The present invention shall be explained further in examples and Figures where:

FIG. 1 discloses in a part cross section view, parts of a cell of Hall-Héroult type where a lid of the superstructure is in place, FIG. 2. discloses in a part cross section view, the particulars of a cell of FIG. 1 where the lid is removed, FIG. 3 discloses application of ACM in a cell as shown in FIG. 2, where a shuttering is in place, the application of ACM has just started, FIG. 4 discloses application of ACM in a cell as of FIG. 3 where a shuttering is in place and the application of ACM has stopped, FIG. 5 discloses application of ACM in a cell as of FIG. 2 where a shuttering is in place, the application has just started, and a ventilation opening is closed, FIG. 6 discloses application of ACM in a cell where a shuttering is in place and the application has stopped, and a ventilation opening is closed, FIG. 7 discloses the shuttering, seen in perspective, FIG. 8 shows an ACM applicator plate arranged at a filling tube for ACM, in a front perspective view, FIG. 9 shows the ACM applicator plate of FIG. 8 in a back perspective view.

In FIG. 1 it is disclosed in a part cross section view, parts of a cell of an Hall-Héroult type where a lid 20 of the superstructure's hood is in place. The lid is shown in part resting onto a threshold 30 being integrated with a deck plate 27. The deck plate is further integerated with a steel shell 25 and a vertical beam 26 constituting part of the cathode shell structure. Inside the steel shell 25 there are commonly a lining 24, solidified bath 23 forming a side ledge, molten bath 22 and an anode 21. All components partly are shown. At the outside of the cell, there is a floor structure 29, commonly made of concrete. Ventilation openings 28 are arranged between the cell and the floor structure. The ventilation openings normally forms a part of the floor by having gratings installed.

In FIG. 2. It is disclosed the particulars of a cell as that of FIG. 1 where the lid is removed. It should be understood that in practice one or more lids are removed to gain sufficient access to the actual anode(s).

FIG. 3 discloses application of Anode Covering Material (ACM) in a cell where a shuttering 40 is in place, the application of ACM via a feed tube 1 has just started and ACM material is partly filling the void between the anode 21 and the shuttering plate 41. The shuttering 40 may be put into position by a manipulator arm on a Pot Tending Macine (PTM) that operates a handle 43 of the shuttering, and brought to rest on the threshold 30 via a recess 42 in a frame part of the shuttering 40. The shuttering itself is explained in more details with reference to FIG. 7.

At a lower part of the shuttering frame 40 there is arranged a swingable or rotable support part 44 that lays onto a support represented by a ventilation grille or louvre at a ventilation opening 28 outside the cell. The support part is swingable about a pivot 45 and may further be fixed or locked (by bolts) in a certain angular position. As a result the shuttering 40 may be turned about the threshold 30. As a consequence, the angle a of the shuttering plate 41 can be predefined in accordance to the desired static angle of repose of the applied ACM. One further advantage by this feature is that the shuttering can be easily adapted to fit various configurations of cell designs and heights of the threshold 30. The angle $\alpha$ can for instance be less than 60° and greater than 30°, preferably approximately 45°.

FIG. 4 discloses the same as in FIG. 3 where the application of ACM has stopped and the feed tube 1 has been removed. Further, a flap shuttering plate 46, hingedly arranged to the shuttering plate 41 via one pivot 47 is folded out to a position being substantially in planar alignment with the shuttering plate 41. This results in that the ACM is packed onto the top-side region of the anode 21.

FIG. 5 discloses the similar situation as that of FIG. 3 where ACM is applied in a cell and where a shuttering 40 is in place. In this embodiment a ventilation opening 28 outside the opening in the hood where the lid(s) is removed is closed by a plate 50 that blocks the air from flowing through the grille or louvre of the ventilation opening.

FIG. 6 discloses the similar situation as that of FIG. 4 where the application of ACM is completed and where a shuttering 40 is in place. The feed tube 1 has been removed. Similarly to that explained in relation to FIG. 5, the ventilation opening 28 outside the the opening in the hood where the lid(s) is removed is closed by the plate 50 that blocks the air from flowing through the opening. The flap shuttering plate 46 has been folded out. The plate can be attached to the shuttering 40 by means of brackets or arms (not shown).

The shuttering 40 is disclosed in perspective in FIG. 7. The mechanism for moving the flap shuttering plate 46 is shown by a device 54 for converting lineary movement at handle 43 to rotational movement of axle 58. The axle is rotational supported by bearings 55. Further, to explain the movement of the flap shuttering plate 46, a lever 51 is fixed to the axle 58 and via linkage 49 it interconnects the bracket 48 via a pivot. The bracket 48 is fixed to the upper shuttering plate 46. In the Figure, there are show in total four linkage arrangements as described above.

Thus the handle 43 can be applied by a manipulator arm for instance on a PTM both to bring the shuttering in position in the cell, and also by pushing the handle downwards to fold out the upper shuttering plate.

The plate 50 that blocks the ventilation openings 28 may be attached to the shuttering 40 at rod 53 by means of brackets or the similar (not shown). Further, plate can be made out of a non-magnetic material. Similarly, the components of the shuttering can preferably be manufactured out of non-magnetic components with a certain heat resistance.

In FIG. 8 an ACM applicator is shown in a front perspective where a feed tube 1' connected with a storage bin (not shown) can feed material through an outlet 2' and onto an anode (not shown). In this embodiment, the outlet 2' can be arranged at a less vertical position than that of the feed tube 1'. At the back side of feed tube 1' there is a bracket 6 that supports an actuator 5 of piston 8/cylinder 10 type that can operate an applicator plate 3 via a joint 9. The actuator 5 can be driven by pressurized air, and further being able swing the applicator plate both inward and outward around its pivot joint 4 with respect to the position shown in FIGS. 8 and 9. The applicator plate 3 may have reinforcing ribs 7, and be made out of any appropriate material, in particular a metallic material such as aluminium or steel.

Further, the applicator plate 3 can be made out of two plate sections 3*a* and 3*b* that are hinged together along line 11. The hinge is arranged in a manner where the plate section 3*b* is allowed to swing inwards towards the outlet 2, but restricted from swinging outwards more than being in planar alignment with plate section 3*a*. The purpose of this feature is that the applicator plate will become more flexible when manoeuvring it in narrow spaces.

In FIG. 9 the applicator is shown in a back perspective view and the reference numerals refers to the same items as that given in FIG. 8.

After the application of ACM has terminated, the shuttering 40 and possibly the cover plate 50 (if applied) are removed and the lid(s) that has been removed is put into place.

In general, if the applied ACM contain fines, the insulation properties will be good but the rather low angle of repose may cause problems by its application.

By using the invention, such material can be applied with a high angle of repose, which will represent high energy preservation potential.

Some ACM production facilities produce ACM with a rather high content of fines. A high content of fines may increase dusting, spillage out of the cell and into the basement, and create a flat angle of repose with poor covering properties or excessive use of ACM material.

According to the invention, ACM with high content of fines can still be applied to some extent, thus saving investment costs in the ACM production facilities.

The ACM spillage in the basement can be minimised, hence saving operational costs for cleaning.

The ACM contribution to dust emissions both inside and outside the plant can be reduced.

The inhered properties of ACM with a high content of fines are the difference in the static and dynamic angle of repose. The idea is to harvest this difference, and by this also benefit from the good thermal capacity of the fine content.

The invention claimed is:

1. A method of applying an anode covering material in an electrolysis cell for aluminium production, the method comprising:

(a) providing an electrolysis cell for aluminium production, wherein the electrolysis cell is a Hall-Héroult type electrolysis cell with prebaked anodes (21),
wherein the electrolysis cell comprises
a cathode pot with a rectangular footprint, and
a superstructure with a gas collecting hood that lays onto a top of the cathode pot,
wherein a floor construction (29) at least substantially surrounds the electrolysis cell at a level below the top of the cathode pot,
wherein ventilation openings (28) are arranged in the floor construction (29) in close vicinity to the electrolysis cell, and
wherein the gas collecting hood of the superstructure comprises one or more removable lids (20) that are removed for giving access to the prebaked anodes (21) in the electrolysis cell through openings, (b) removing the one or more removable lids (20), (c) positioning a shuttering frame (40) with a movable shuttering plate (41) in a bottom sector of the openings, and (d) applying the anode covering material via a feed tube (1, 1') to cover the prebaked anodes (21), wherein at least a part of the movable shuttering plate (41) is tilted at an angle ($\alpha$) towards the prebaked anodes (21) thereby restricting anode covering material from flowing out of the openings in the electrolysis cell during application of the anode covering material such that the anode covering material is packed onto a top-side region of the prebaked anodes (21), wherein the angle ($\alpha$) is between 30° and 60°.

2. The method in accordance with claim 1, wherein the movable shuttering plate (41) has an angular position that affects an angle of repose of the anode covering material during application.

3. The method in accordance with claim 1, wherein the angle (a) is approximately 45°.

4. The method in accordance with claim 1, wherein the ventilation openings (28) in the floor construction (29) adjacent the openings in the superstructure are closed during anode covering material application.

5. The method in accordance with claim 4, wherein the ventilation openings (28) in the floor construction (29) in the area where the one or more removable lids (20) are removed are closed by a plate (50) that is arranged to lay onto and cover the ventilation openings (28).

6. The method in accordance with claim 1, wherein an applicator plate (3) is arranged at an outlet (2') of the feed tube (1, 1') to guide positioning of anode covering material.

* * * * *